US005983505A

United States Patent [19]

Gibson

[11] Patent Number: 5,983,505

[45] **Date of Patent: *Nov. 16, 1999**

[54] BAGEL SLICER

[75] Inventor: Jeremy H. Gibson, Eastlake, Ohio

[73] Assignee: Faye Fong Chen, Ann Arbor, Mich.

[ * ] Notice: This patent is subject to a terminal disclaimer.

[21] Appl. No.: 09/166,683

[22] Filed: Oct. 5, 1998

Related U.S. Application Data

[63] Continuation-in-part of application No. 08/962,614, Nov. 3, 1997, Pat. No. 5,903,982.

[51] Int. Cl.[6] ..... B26B 3/00; B26B 3/03

[52] U.S. Cl. ..... 30/282; 30/279; 30/294

[58] Field of Search ..... 30/114, 124, 136, 30/278, 282–285, 289, 293, 294; 83/762; 99/442, 537; D7/693, 696, 381

[56] References Cited

PUBLICATIONS

See Photographs and Explanation.

*Primary Examiner*—Douglas D. Watts

*Attorney, Agent, or Firm*—Driggs, Lucas, Brubaker & Hogg Co., L.P.A.

[57] ABSTRACT

A hand-held bagel slicer is described for circumferentially slicing a bagel into two equal halves. The slicer comprises a generally U-shaped clip attached to a handle. The clip comprises a generally semi-circular bight and two flexible legs. The legs converge slightly from the bight to their free ends to hold the bagel sideways, and the free ends are outwardly flared to facilitate insertion of the bagel for slicing. Midway between the two legs is a 2 edged knife blade. The blade has a base secured to the bight and a tip terminating in a point. The blade is about 50 to 75% of the length of the legs. The free end of the handle is generally elliptical in cross section. The handle decreases in cross-sectional size and becomes generally rectangular in shape toward the flared end. The clip is joined to a core which has one or more small cross ribs extending laterally from a center rib to match with a similarly shaped recess in the handle to prevent relative rotation between the handle and the clip. Proper tension for holding the bagel while slicing is maintained by controlling the thickness of the clip in the region of the bight.

6 Claims, 3 Drawing Sheets

BAGEL SLICER

CROSS REFERENCE TO RELATED APPLICATION

This application is a continuation-in-part of patent application Ser. No. 08/962,614 Filed Nov. 3, 1997, now U.S. Pat. No. 5,903,982, issued May 18, 1999.

FIELD OF THE INVENTION

This invention relates to a kitchen utensil. More particularly this invention relates to a hand-held slicer useful in slicing a bagel, muffin or donut into two circumferentially equal halves.

BACKGROUND OF THE INVENTION

Bagels have become enormously popular in recent years. They are prepared from plain yeast dough which is dropped briefly into boiling water and then baked. The product is a ring-shaped roll having a soft or hard surface and a tough chewy texture. There are many varieties of bagels including pumpernickel, raisin, whole wheat, sesame seed, and others too numerous to mention. Typically, the bagels are sliced in half before eating. They then are made into a sandwich, or are served with suitable spread such as jam or cream cheese.

Because of the differences in skin hardness and chewy texture of the bagel, as well as its irregular shape, it is not always an easy task to cut the bagel into two halves which are of equal size. A number of devices have been designed for slicing or cutting the bagel into halves, but they have all suffered from one or more deficiencies which have limited their commercial utility. These devices have been unduly complex, are difficult to clean, or are unsafe to use. Some of them utilize a powered rotary slicer, or movable parts. Others do only a marginal job of dividing the bagel into two approximately equal halves, particularly with respect to soft skin bagels which tend to tear into irregular pieces when cut.

SUMMARY OF THE INVENTION

It is at an objective of the present invention to provide a simple hand tool for slicing bagels into equal halves.

It is another objective of the present invention to provide a kitchen utensil constructed to be safe, reliable and easy to use for slicing bagels and the like.

These and other objectives are accomplished in a manner to be hereinafter described, with particular reference to a bagel slicer comprising a generally U-shaped clip for positioning a bagel for slicing into two halves. The clip comprises a generally semi-circular bight, and two legs of generally equal length joined to the bight. The legs have a generally flexible free end, and the opening near the two free ends is normally narrower than the opening of the bight. The free end of one leg is flared away from the free end of the other leg. The slicer includes a knife blade within the clip midway between the legs. It is secured to the bight of the clip. The knife blade has a base and a tip, with at least one and preferably two cutting-edges between the base and the tip. The length of the blade is less than a length of the legs. One and preferably both of the cutting edges of the blade are serrated. The length of the knife blade is between about 60% and about 90% of the length of the legs. The base of the blade has a width at the bight of the clip between about 30% and about 70%, preferably about 50% of the width of the bight. The slicer also includes a handle attached to the clip at the bight, in axial alignment with the clip. The handle of the bagel slicer has a first end abutting the clip and a second end. The handle has a cross-section which is generally rectangular near the first end, and is generally elliptical at the second end. The handle is tapered outwardly from the rectangular cross-section to the elliptical cross-section. The clip is molded from a polymer such as acrylonitrile butadiene styrene (ABS) and includes a handle core. The handle is made from an elastomer which fits around and can be adhesively secured to the handle core. The handle core preferably has a cross-sectional shape comprising a center rib and one cross rib or two cross ribs spaced from one another, similar to a Swiss cross.

The base of the knife blade includes a spine embedded in the core. The spine is an extension of the blade and is narrower than the blade. The spring tension of the clip preferably is controlled by maintaining the wall thickness of the clip between about 80 mils and about 120 mils in the region of the bight.

The present invention also relates to a bagel slicer comprising a generally U-shaped clip for positioning a bagel as it is being circumferentially sliced. The clip includes a generally semicircular bight and a pair of legs, each leg having a free end. The legs have a slight convergence from the bight toward the free end and are flexible to receive a bagel sideways therebetween. The opening of the clip at the bight is greater than the opening near the ends of the legs. The clip includes a handle core integrally molded thereto extending axially therefrom in the direction opposite the legs. A serrated knife blade includes a spine imbedded in the handle. The blade extends from the bight midway between the legs, with the maximum width of the blade being about 40% to about 60% of the width of the bight, and height of the blade being between about 60% and about 90% of the length of the legs. A handle surrounds and is secured to the handle core and preferably has a non-slip gripping surface. The handle has one end in proximity to the bight, and a second free end remote therefrom. The handle is generally rectangular near the first end thereof in proximity to the bight, and is generally elliptical at the free end. The cross-section of the handle at the free end is larger than the cross-section in proximity to the bight. The spacing between the legs at the bight is between about 1¼ and about 1¾, preferably about 1½. The spacing near the free end of the leg is between about ¾ and 1¼, preferably about 1 in. The free ends of the legs are flared away from one another to facilitate insertion of the bagel into the bagel slicer. The wall thickness of the clip in the region of the bight preferably is between about 80 mils and about 120 mils when the clip is molded from an ABS copolymer. The core has a cross-sectional shape comprising a central rib and one or two cross ribs. The latter pattern is similar to that of a Swiss cross.

The invention further involves a slicer comprising a molded polymeric, generally U-shaped clip for positioning a bagel to be sliced into two halves, the clip preferably molded from a copolymer of acrylonitrile butadiene styrene. The clip comprises a generally semi-circular bight, and two legs joined to the bight, each leg terminating in a generally flexible free end. The opening of the bight is normally wider than the opening of the legs near the free ends. A knife blade is positioned midway between the legs of the clip and is secured at the bight thereof. The blade has a base, a tip, and at least one, preferably two cutting edges between the base and the tip. The length of the blade is less than the length of the legs and the width of the blade at its base is less than the width of the bight. A handle is attached to the clip at the bight and is in axial alignment therewith. The slicer is improved by maintaining the spring tension of the clip at an optimum value for holding the bagel as it is being sliced.

This is achieved by controlling the wall thickness of each leg in the region of the bight between about 80 mils and about 120 mils. The region of the bight is generally determined to be between about ¼ and ½ of the length of each leg.

DETAILED DESCRIPTION OF THE INVENTION

Figure 1:
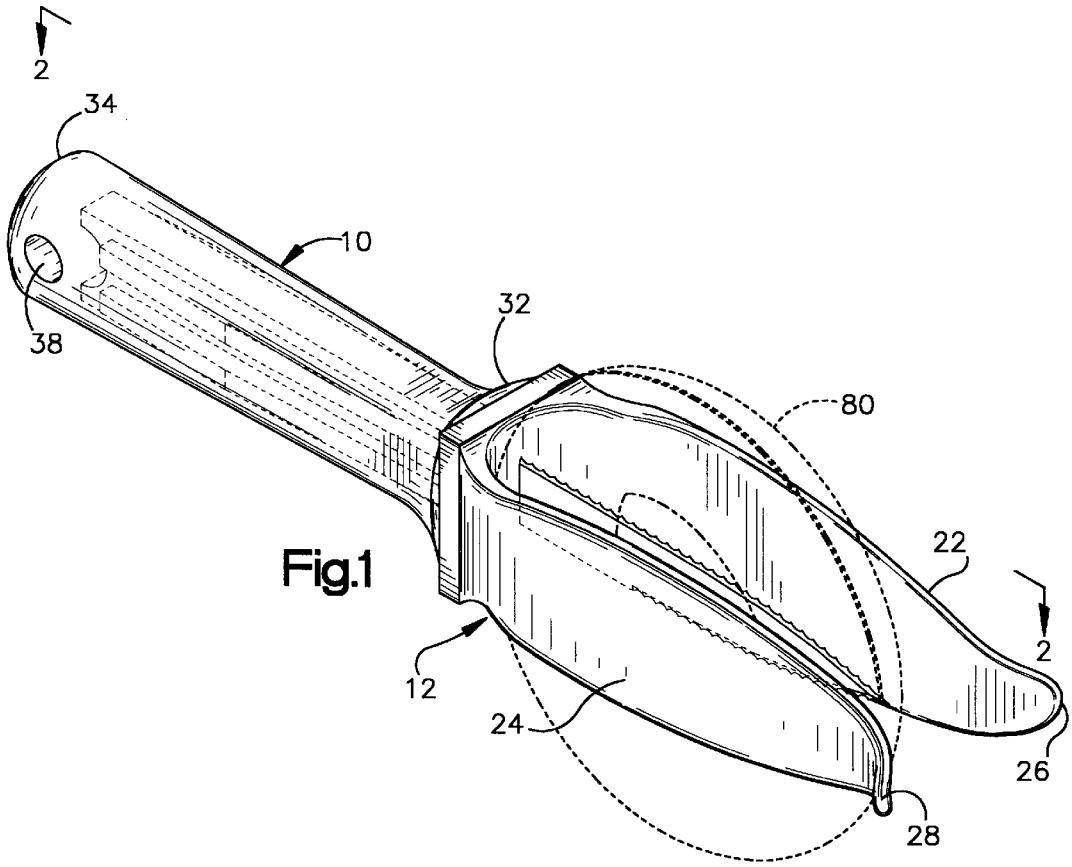
FIG. 1 is a perspective view of the slicer of the present invention.
Figure 4:
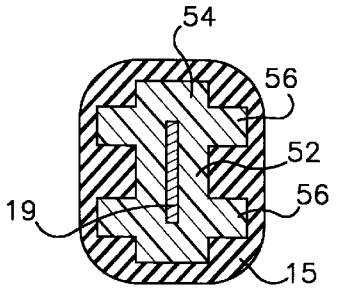
FIG. 4 is a cross-section of the handle taken along lines 4—4 of FIG. 2.
Figure 5:
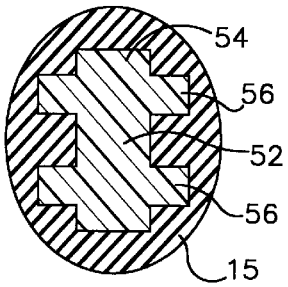
FIG. 5 is a cross section of the handle taken along lines 5—5 of FIG. 2.

Referring in more detail to the drawings, a perspective view of the bagel slicer of the present invention is shown in FIG. 1. The slicer 10 comprises a clip 12 secured to a handle 14, and a knife blade 16. The clip is generally U-shaped and comprises a semi-circular bight 20, and first and second legs 22, 24 terminating in free ends 26, 28 which are flared away from one another to facilitate insertion of the bagel, muffin or other donut shaped or cylindrical item 80 (shown in outline between the legs of the clip). The clip typically is formed by injection molding from a suitable polymer such as polyethylene, or polypropylene or a copolymer such as acrylonitrile-butadiene-styrene (ABS). The opening of the clip at the bight is typically about 1½. The legs are flexible, and can be spread apart to receive the end of a bagel, shown in phantom in FIG. 1. When the legs are in their normal position, when not holding a bagel, the opening between them is less than the opening at the bight. An opening of about 1" has been found to be satisfactory for the legs. The handle 14 includes a first end 32 joined to the bight 20 of the clip 12, and a second end 34 remote from the clip 12.. The handle preferably has a textured surface made from an elastomeric material such as Santoprene which provides a soft, sure grip and is dishwasher safe. The functional shape of a preferred handle for the present invention is covered by U.S. Pat. No. 5,535,484 by the present inventor, the contents of said patent being incorporated herein by reference. The first end 32 of the handle is slightly flared to abut the clip and can contain a plurality of gripping ribs as shown in the patent. This end is generally rectangular in cross-section with slightly rounded edges as seen in FIG. 4 for comfort in handling. The second end 34 is generally elliptical, as shown in FIG. 5 and typically has a hole 38 for use when hanging up the device for drying or storage. The handle has a slight outward taper from the first end to the second end whereby the elliptical cross section of the second end is larger than the rectangular cross-section of the first end. The transition from the smaller rectangle to the larger elliptical cross-section is gradual, to facilitate gripping, and to help to prevent slipping of the bagel slicer from the hand of the user. These features all are described in greater detail in the aforementioned patent. It should be understood that other handles having different other shapes and configurations can likewise be used in the teachings of the present invention.

The knife blade 16 is centered between the legs 22, 24 of the clip, parallel to the planar surfaces of the legs. The blade comprises a base 42 connected to the bight 20, a tip 44 and cutting edges facing the opening between the legs. To facilitate the slicing action of a blade, one or both of the cutting edges are provided with serrations 48 (shown in FIG. 3). The width of the blade is approximately 30 to 70%, preferably about 50% of the width of the clip at the bight. The blade has a functional length which is sufficient to cut through the ring of the bagel, or past the axial center of a muffin. The length is shorter than the length of legs 22, 24, thereby providing shielding for the blade and protection to the user from inadvertent injury. Preferably the length of blade is about 60–90% of the length of the legs or the length of the shorter leg if they are of unequal length. Typically the blade is made from a suitable metal such a stainless-steel or other hardened steel which will maintain its cutting-edge without re-sharpening. The tip 44 of the blade is preferably pointed to facilitate insertion of the blade into the bagel. However, the point should not be so sharp as to pose a dangerous risk to the user.

Figure 2:
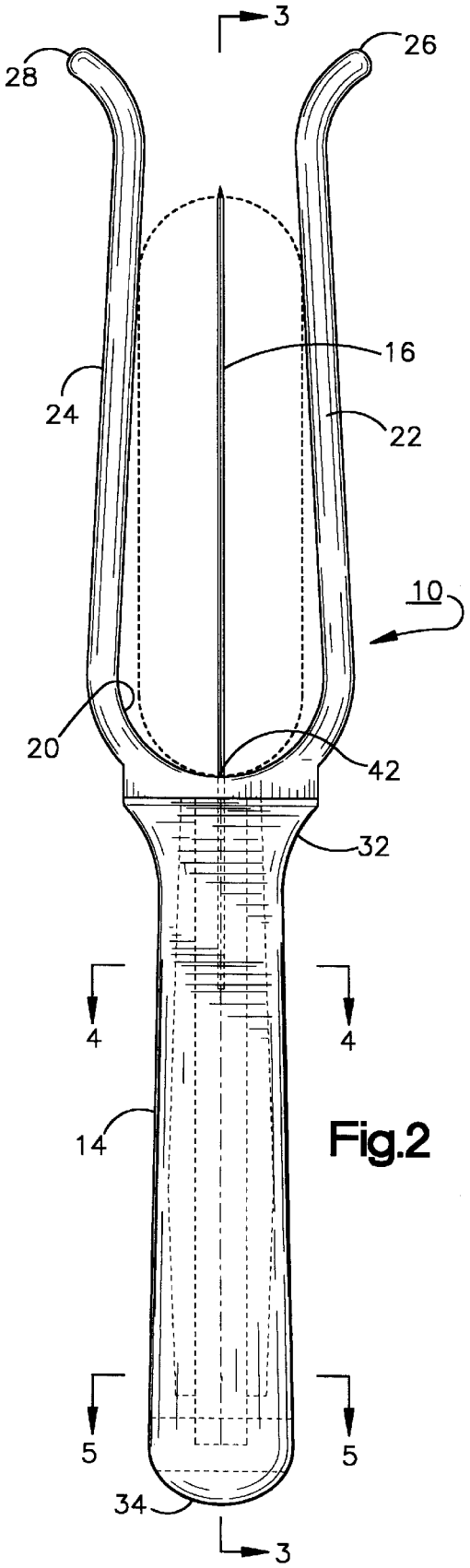
FIG. 2 is a front elevational view of the slicer.

FIG. 2 shows the bagel slicer 10 with a bagel 80 positioned between the legs 22, 24 of the clip 12. The legs are shown converging toward one another from the bight to the ends. The flared ends 26, 28 of the legs permits easy insertion of the bagel between the legs, and the resilience or spring tension of the converging legs holds the bagel in place as it is manually rotated and circumferentially sliced.

The thickness of the legs in the region generally designated as "a" is preferably between about 80 and 120 mils when the legs are molded from an acrylonitrile butadiene-styrene polymer. The thickness when using other polymers can readily be ascertained by routine experimentation. Although the bight 20 is shown as semi-circular in shape, it can be oval in shape or can have a multiple radii rather than a single radius without departing from the present invention.

Figure 3:
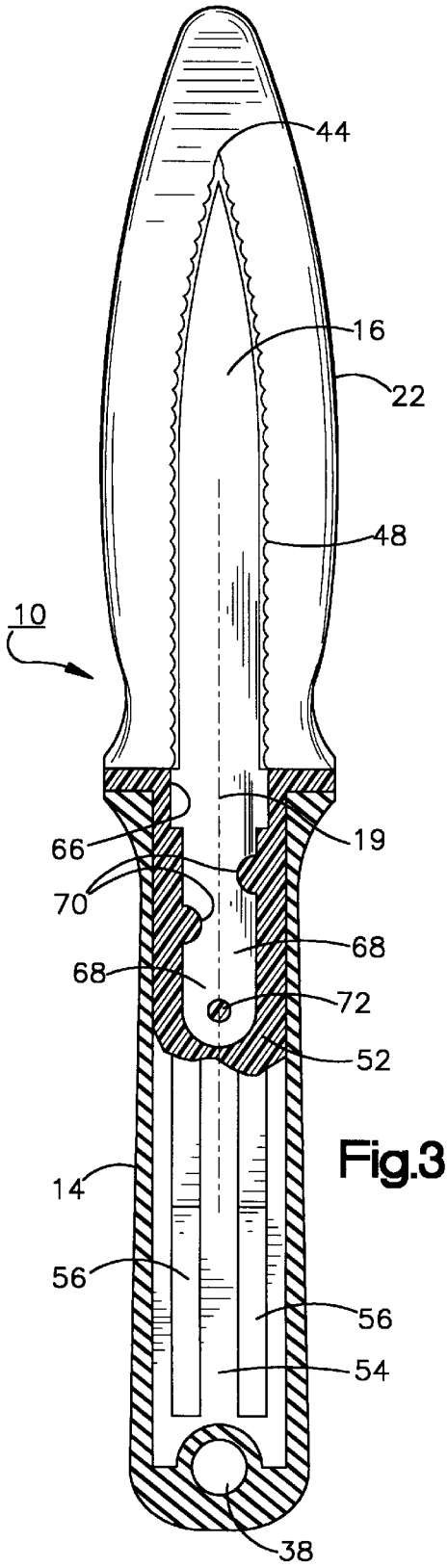
FIG. 3 is an elevational view, with the front leg of the clip removed and the handle shown in cross section.

FIG. 3 shows the bagel slicer of the present invention partially in cross-section to clarify its construction. The clip 12 is integrally joined to a core 52 having a center rib 54 and four cross ribs 56 extending laterally therefrom, generally in the shape of a Swiss cross. The handle 14 is molded or otherwise formed to have a recess conforming to the cross-section to the core. The core is inserted into the handle and optionally may be bonded thereto with a suitable polymeric adhesive such as an epoxy or methacrylate resin. Alternatively, the handle may be molded around the core by injection molding or other similar process.

The front leg is removed to show the knife blade which includes a spine 19 embedded in the core 52. Typically, the knife blade is positioned in the mold, and the core is molded around the spine, thereby permanently anchoring the blade in position. The spine extends a sufficient distance into the core to insure repeated use of the slicer without loosening the blade from the core. It comprises a first portion 66 which is an extension of the blade and is approximately the same width as the blade. It also includes a second extension 68 having a reduced width. One or more notches 70, and aperture 72 in the spine serve to increase the bond between the spine and the core thereby further improving the durability of the utensil and reducing the likelihood of the knife becoming loose.

Referring now to FIG. 4, the handle, blade and core are shown in a cross-section taken near the end 32 of the handle toward the clip. As can be seen, the core 52 comprises a center rib 54, and cross ribs 56. Embedded in the core is the part of the base 42 and the spine 19 of the knife blade. Surrounding the core and securing it against rotation is a slip-proof elastomer 15 such as Santoprene. The handle has a generally rectangular shape with rounded comers for gripping comfort.

The free end 34 of the handle is shown in cross-section in FIG. 5. This end has a generally elliptical shape which, typically is slightly larger in cross section than the corresponding shape at the other end of the handle. The core 52 has the same shape as shown in FIG. 4. The elastomer 15 surrounding the core 52 at this end 34 of the handle is thicker than the elastomer at the other end 32. This handle shape generally conforms to the teachings of U.S. Pat. No. 5,535,484 and helps the user firmly grip the device while slicing a bagel.

Figure 6:
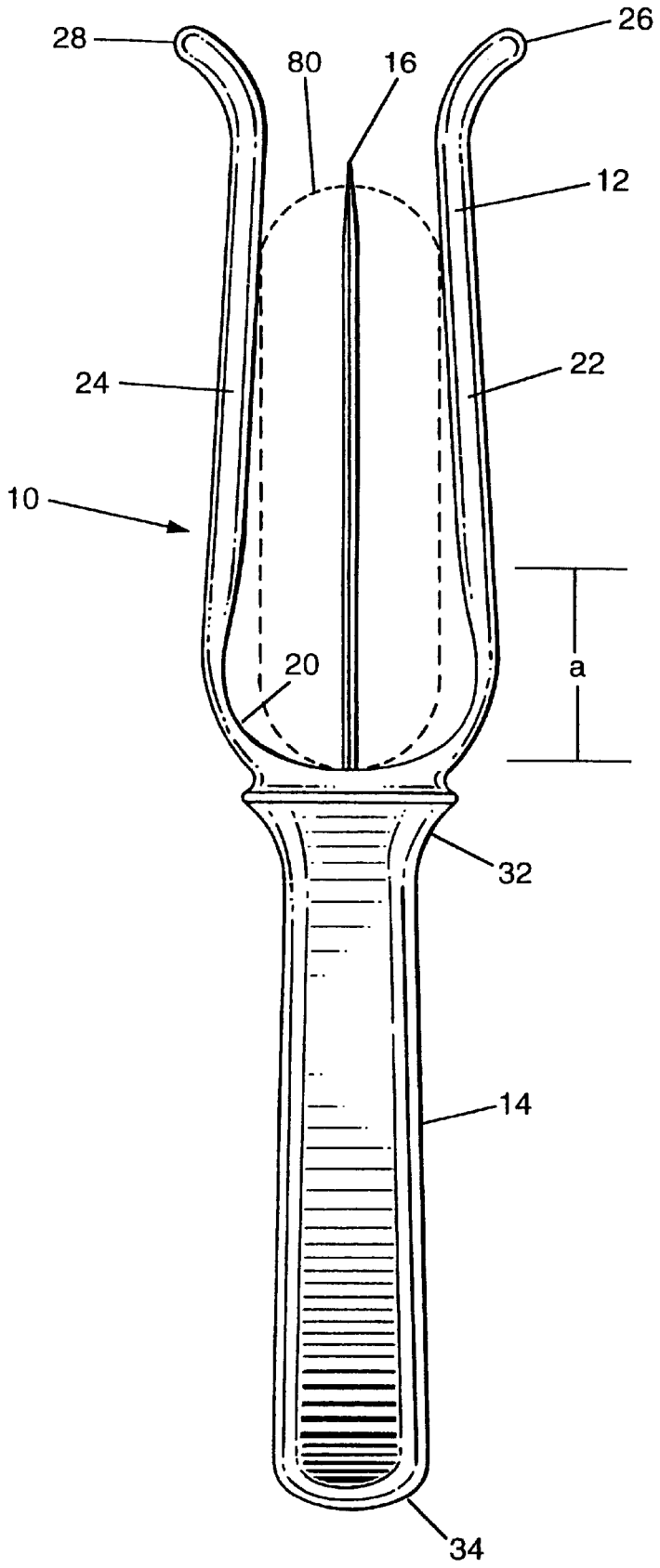
FIG. 6 is a front elevational view showing a variation of the slicer of the present invention

The bagel slicer 10 shown in FIG. 6 is similar in construction and details to the bagel slicer shown in FIGS. 1–5, and the same numerals are used to refer to the same parts. Unexpectedly, the ability of the bagel slicer to easily cut soft-skinned bagels as well as hard skinned bagels is achieved by maintaining the proper spring tension of the clip 12. A preferred manner in which this spring tension is regulated is by controlling the thickness of the polymer in the region of the clip designated as "a". This region is between about ¼ to ½ of the length of the legs 22, 24. When molding the clip 12 from a copolymer such as ABS, a preferred thickness is between about 80 and about 120 mils while the thickness of the remainder of the clip is about 150 mils. When using other polymers, the corresponding thickness is greater or less depending on the physical properties of the polymer, and can be readily determined by routine experimentation to give a spring tension equivalent to that obtained from ABS having the preferred thickness range of 80–120 mils.

Other modifications can be made in the features and construction of the device of the present invention without departing from the scope thereof. For instance, the shape of the clip, the handle and the blade, as well as relative dimensions of each can be varied within the parameters defined herein without adversely affecting the operation thereof. The device is relatively inexpensive to produce. It is simple to use and is made of materials which can be readily cleaned for reuse.

While the invention has been described in connection with specific embodiments thereof, it is evident that many alternatives, modifications and variations will be apparent to those skilled in the art and light of the foregoing teachings. Accordingly, the invention is intended to embrace all such alternatives, modifications and variations that fall within the spirit and scope of the appended claims.

What is claimed is:

1. A slicer comprising a) a molded, polymeric, generally U-shaped clip for positioning a bagel to be sliced into two halves, the clip comprising a generally semi-circular bight, and two legs joined to the bight, the legs each terminating in a generally flexible free end, the opening of the bight normally being wider than the opening near the free ends;

b) A knife blade positioned midway between the legs of the clip and secured at the bight thereof, the blade having a base, a tip, at least one cutting edge between the base and the tip, a length which is less than the length of the legs, and a width at its base which is less than the width of the bight; and c) A handle attached to the clip at the bight in axial alignment therewith; the improvement wherein the clip has a spring tension which is maintained at an optimum value for holding the bagel as it is being sliced.

2. The slicer according to claim 1 wherein the optimum value of the spring tension is maintained by controlling the wall thickness of the legs in the region of the bight between about 80 mils and about 120 mils.

3. The slicer according to claim 2 wherein the clip is molded from a copolymer of acrylonitrile butadiene styrene.

4. The slicer according to claim 1 wherein between about ¼ and about ½ of the length of each leg in the region of the bight is maintained at the controlled thickness.

5. A slicer comprising a) a generally U-shaped clip for positioning a bagel for slicing into two halves, the clip comprising a generally semi-circular bight, and two legs of substantially equal length joined to the bight, the legs having a generally flexible free end, the opening of the bight normally being wider than the opening near the two free ends, the U-shaped clip having a spring tension which is maintained at a predetermined value by maintaining the wall thickness of the clip in the region of the bight at a value of between about 80 mils and about 120 mils, b) A knife blade midway between the legs of the clip and secured at the bight thereof, the blade having a base, a tip, a pair of serrated edges between the base and the tip, a length which is less than the length of the legs, and a width at its base which is about 50% of the width of the bight; and c) A handle attached to the clip at the bight in axial alignment therewith.

6. A bagel slicer comprising:

a) a molded polymeric U-shaped clip for positioning a bagel as it is being sliced circumferentially, the clip molded from a copolymer of acrylonitrile-butadiene-styrene and including a generally semi-circular bight and a pair of legs, each leg having a free end, the legs having a slight convergence from the bight toward the free end and being flexible to receive a bagel sideways therebetween, the opening of the clip at the bight being greater than the opening near the end of the legs, the spacing between the legs at the bight being between about 1¼ and about 1¾, and the spacing near the free ends of the legs being between about ¾ and 1¼ the clip having a wall thickness in the region of the bight between about 80 mils and about 120 mils;

b) a handle core integrally molded to the clip and extending axially therefrom in the direction opposite the legs;

c) a serrated knife blade having a spine embedded in the handle core, the knife blade extending from the bight midway between the legs, the maximum width of the blade being about 40% and 60% of the width of the bight and the height being between about 60% and 90% of the length of the legs; and d) a handle surrounding and secured to the handle core and having a non-slip gripping surface, said handle having one end in proximity to the bight and a free end remote therefrom.

* * * * *

UNITED STATES PATENT AND TRADEMARK OFFICE

CERTIFICATE OF CORRECTION

PATENT NO. : 5,983,505

DATED : November 16, 1999

INVENTOR(S) : Jeremy H. Gibson

It is certified that error appears in the above-identified patent and that said Letters Patent is hereby corrected as shown below:

Column 2, line, line 41, after "about", first occurrence, change "1 ¼" to --1 ¼"--; same line. after "about", second occurrence, change "1 ¾" to --1 ¾"--.

Line 42, after "about" change "1 ½" to --1 ½"--.

Line 43, after "about", first occurrence" change "¾ and 1 ¼" to -- ¾ " and 1 ¼"--.

Column 3, line 35, after "about" change "1 ½" to --1 ½"--.

In the Claims, claim 6, column 6, line 46, after "about", first occurrence", change "1 ¼" to --1 ¼"--, same line, after "about", second occurrence, change "1 ¾" to --1 ¾"--.

Line 47, after "about", change "¾ and 1 ¼" to --¾" and 1 ¼"--.

Signed and Sealed this

Twenty-third Day of May, 2000

*Attest:*

*Attesting Officer*

Q. TODD DICKINSON

*Director of Patents and Trademarks*